US011783767B1

(12) United States Patent
Liu et al.

(10) Patent No.: US 11,783,767 B1
(45) Date of Patent: Oct. 10, 2023

(54) DISPLAY DRIVING CIRCUIT, DISPLAY DRIVING METHOD AND DISPLAY DEVICE

(71) Applicant: HKC CORPORATION LIMITED, Shenzhen (CN)

(72) Inventors: Xiangheng Liu, Shenzhen (CN); Jun Shi, Shenzhen (CN); Tingting Yang, Shenzhen (CN); Chunyan Li, Shenzhen (CN); Yun Lin, Shenzhen (CN); Zhihao Wang, Shenzhen (CN); Haijiang Yuan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/329,362

(22) Filed: Jun. 5, 2023

(30) Foreign Application Priority Data

Oct. 28, 2022 (CN) ..... 202211330825.0

(51) Int. Cl.
*G09G 3/32* (2016.01)

(52) U.S. Cl.
CPC ..... *G09G 3/32* (2013.01); *G09G 2310/08* (2013.01); *G09G 2320/0247* (2013.01)

(58) Field of Classification Search
CPC ..... G09G 2320/0247; G09G 3/32; G09G 2310/08
See application file for complete search history.

(56) References Cited

U.S. PATENT DOCUMENTS

2010/0128004 A1* 5/2010 Harada ..... G06F 3/0412 348/311
2012/0262424 A1* 10/2012 Tanaka ..... G06F 3/042 345/175
2018/0181242 A1* 6/2018 Mizuhashi ..... G06F 3/0446
2019/0045595 A1 2/2019 Johnsen et al.

FOREIGN PATENT DOCUMENTS

| | | |
|---|---|---|
| CN | 1886015 | 12/2006 |
| CN | 201698711 | 1/2011 |
| CN | 205354617 | 6/2016 |
| CN | 115101006 | 9/2022 |

OTHER PUBLICATIONS

CNIPA, First Office Action for CN Application No. 202211330825.0, dated Dec. 5, 2022.
CNIPA, Notification to Grant Patent Right for Invention for CN Application No. 202211330825.0, dated Dec. 26, 2022.

* cited by examiner

*Primary Examiner* — Muhammad N Edun
(74) *Attorney, Agent, or Firm* — Hodgson Russ LLP

(57) ABSTRACT

A display driving circuit includes a light emitting assembly which includes a first control switch having a first terminal connected to a cathode of the light emitting unit, a second terminal connected to a common terminal, and a control terminal connected to a first signal wire to provide a first control signal and a second control switch having a first terminal connected to a charging terminal, a second terminal connected to an anode of the light emitting unit and a control terminal connected to a second signal wire to provide a (Continued)

second control signal. When the light emitting unit is turned off, the first control switch disconnects the cathode of the light emitting unit and the common terminal in response to the first control signal, and the second control switch disconnects the anode of the light emitting unit and the charging terminal in response to the second control signal.

20 Claims, 6 Drawing Sheets

DISPLAY DRIVING CIRCUIT, DISPLAY DRIVING METHOD AND DISPLAY DEVICE

CROSS-REFERENCE TO RELATED APPLICATIONS

This application claims priority to Chinese Patent Application No. 202211330825.0, filed Oct. 28, 2022, the entire contents of which are incorporated herein by reference.

TECHNICAL FIELD

The present disclosure relates to the display driving technical field, in particular to a display driving circuit, a display driving method and a display device.

BACKGROUND

In a display panel, the LED (Light Emitting Diode) is lighted by energizing the TFT (Thin Film Transistor). However, there is an electricity leakage in the TFT switch, the electricity leaked from the TFT switch easily flows to the LED, as a result, the LED can be affected by an external environment, and fluctuation and flashing occur in a brightness of the LED. Normal display of the display panel can be affected by the flashing of the brightness of the LED, and thereby deteriorating a display effect of the display panel.

SUMMARY

There are provided a display driving circuit, a display driving method and a display device according to embodiments of this application. The technical solution is as below:

According to a first aspect of the present disclosure, the present disclosure provides a display driving circuit, the display driving circuit includes a light emitting assembly, the light emitting assembly includes a light emitting unit, and the light emitting assembly further includes:

a first control switch having a first terminal connected to a cathode of the light emitting unit, a second terminal connected to a common terminal, and a control terminal connected to a first signal wire, the first signal wire being configured to provide a first control signal; and a second control switch having a first terminal connected to a charging terminal, a second terminal connected to an anode of the light emitting unit, and a control terminal connected to a second signal wire, the second signal wire being configured to provide a second control signal;

wherein when the light emitting unit is turned off, the first control switch disconnects the cathode of the light emitting unit and the common terminal in response to the first control signal, and the second control switch disconnects the anode of the light emitting unit and the charging terminal in response to the second control signal;

wherein the light emitting assembly further comprises a reset switch, the reset switch has a first terminal connected to a voltage reset terminal, a second terminal connected to the anode of the light emitting unit, a control terminal connected to a reset signal wire, the voltage reset terminal is configured to provide a reset voltage, and the reset signal wire is configured to provide a reset signal; and when the light emitting unit is turned off, the reset switch communicates the anode of the light emitting unit and the voltage reset terminal in response to the reset signal; the voltage reset terminal provides the reset voltage to the anode of the anode of the light emitting unit so that the light emitting units maintain the same reference voltage before being charged;

wherein the reset switch, the first control switch and the second control switch are connected to an identical scanning terminal, and the reset signal, the first control signal and the second control signal are identical scan signals; and the reset switch is one of a P-type field-effect transistor and an N-type field-effect transistor, and the first control switch and the second control switch are the other one of the P-type field-effect transistor and the N-type field-effect transistor.

According to a second aspect of embodiments of the present disclosure, the present disclosure further provides a display driving method applied to the display driving circuit as described above, the display driving method including:

transmitting a first control signal to a first control switch, the first control switch disconnecting a first terminal and a second terminal in response to the first control signal, so that a cathode of a light emitting unit is disconnected from a common terminal; and transmitting a second control signal to a second control switch, the second control switch disconnecting a first terminal and a second terminal in response to the second control signal, so that an anode of the light emitting unit is disconnected from a charging terminal.

According to a third aspect of embodiments of the present disclosure, the present disclosure further provides a display device, the display device including a display panel, the display panel having a display area and a non-display area, the non-display area being disposed at a periphery of the display area, the display device further includes the display driving circuit as described above, a first control switch and a second control switch are arranged in the non-display area, and a light emitting unit is located in the display area.

It should be understood that the above general description and the following detailed description are exemplary only and are not intended to limit the present disclosure.

BRIEF DESCRIPTION OF THE DRAWINGS

The above and other objects, features and advantages of the present disclosure will become more apparent by describing exemplary embodiments thereof in detail with reference to the accompanying drawings.

DETAILED DESCRIPTION

Figure 1:
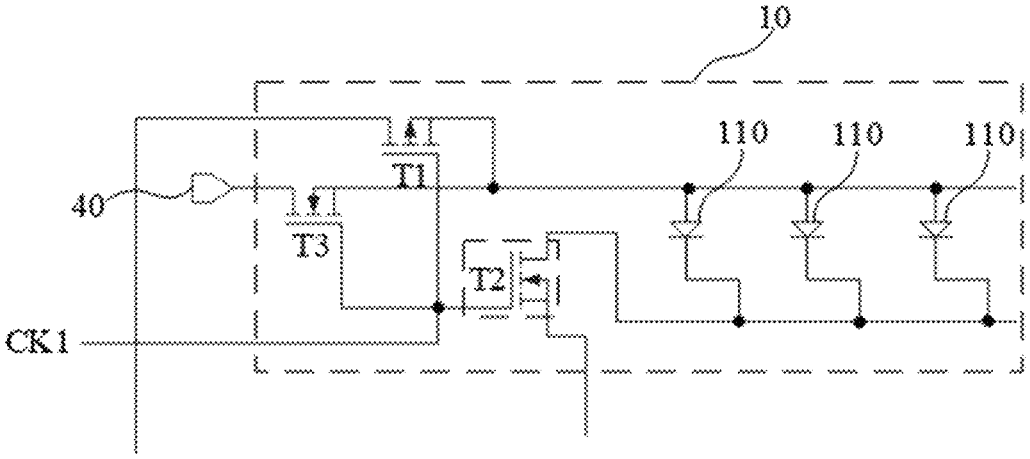
FIG. 1 is a schematic view of circuit connection of a display driving circuit according to a first embodiment of the present disclosure.

Although the present disclosure can readily be embodied in different forms of embodiment, however, only some of the specific embodiments are shown in the drawings and will be described in detail in the description, while it is understood that the description is to be regarded as an exemplary illustration of the principles of the present disclosure and is not intended to limit the present disclosure to those described herein.

Thus, one feature pointed out in the description is intended to illustrate one of the features of one embodiment of the present disclosure and is not intended to imply that each embodiment of the present disclosure must have the illustrated feature. In addition, it should be noted that many features are described in the description. Although certain features may be combined to illustrate a possible system design, these features may also be used for other unspecified combinations. Therefore, unless otherwise stated, the illustrated combinations are not intended to be limiting.

In the embodiments illustrated in the drawings, indications of direction (such as up, down, left, right, front and back) are used to explain that the structure and movement of the various elements of the present disclosure are not absolute but relative. These descriptions are appropriate when these elements are in the positions shown in the drawings. If the description of the positions of the element changes, the indications of the directions change accordingly.

The exemplary embodiments will now be described more fully with reference to the accompanying drawings. However, the exemplary embodiments can be implemented in a variety of forms and should not be construed as being limited to the examples set forth herein. Rather, these embodiments are provided so that the present disclosure will be more comprehensive and complete, and the concept of exemplary embodiments will be fully communicated to those skilled in the art. The accompanying drawings are only schematic illustrations of the present disclosure and are not necessarily drawn to scale. Like reference signs in the figures denote identical or similar parts and thus repetitive descriptions thereof will be omitted.

The embodiments of the present disclosure are further elaborated below in conjunction with the accompanying drawings of the description.

Embodiment 1

Figure 2:
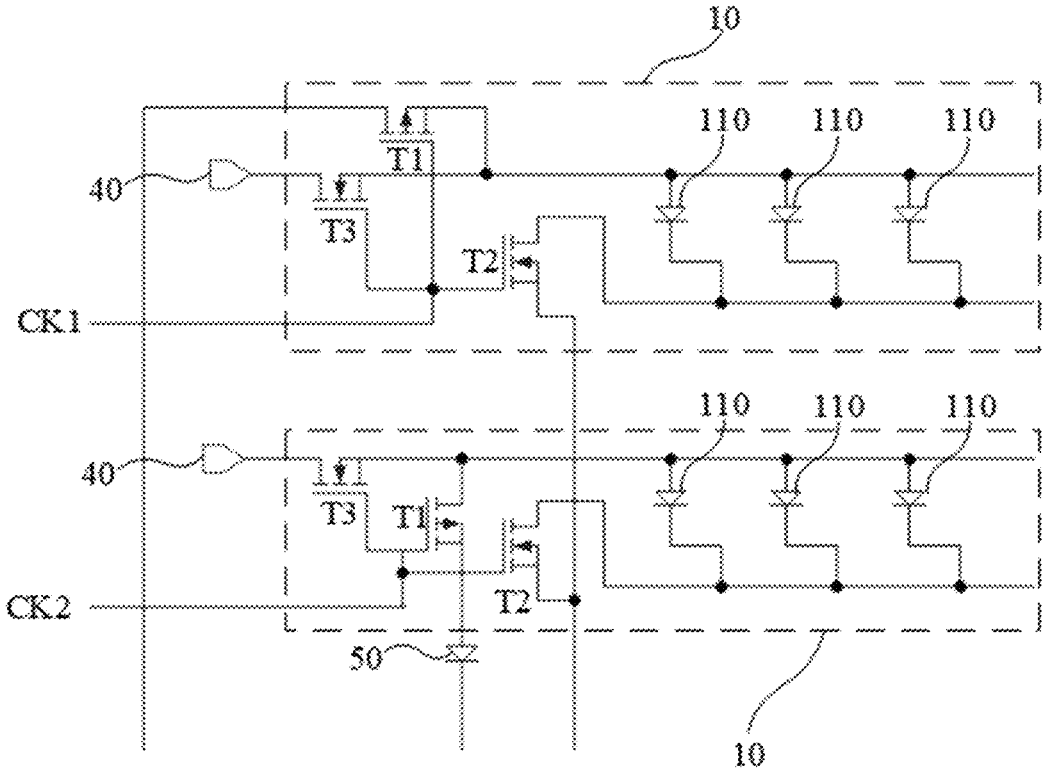
FIG. 2 is a schematic view of circuit connection where two light emitting assemblies in FIG. 1 according to the present disclosure are connected.
Figure 3:
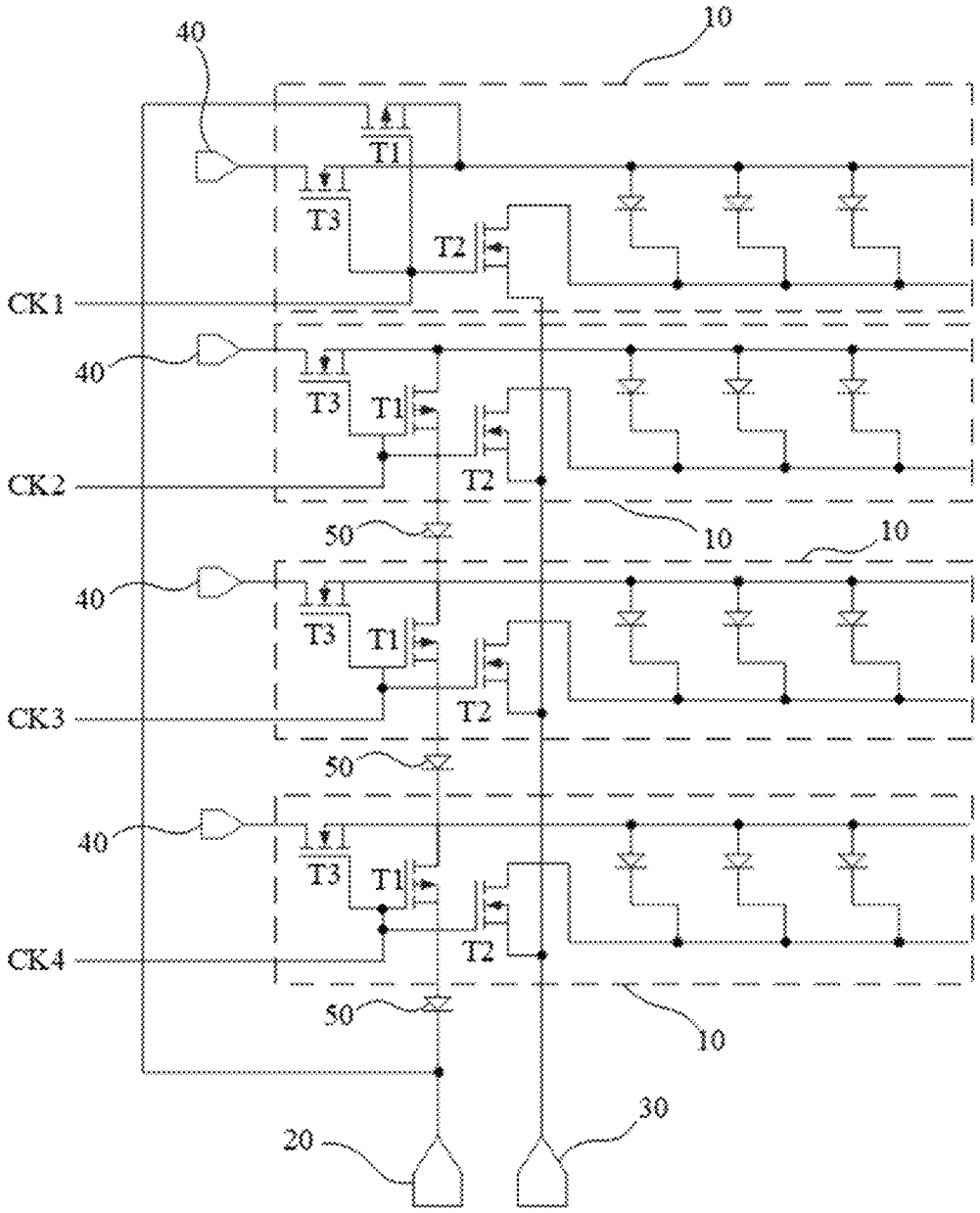
FIG. 3 is a schematic view of circuit connection where four light emitting assemblies in FIG. 1 according to the present disclosure are connected.

Referring to FIGS. 1 to 3, the present disclosure provides a display driving circuit which may be used in a Mini-LED (Mini Light Emitting Diode). The Mini-LED has advantages of high brightness, low loss and long service life.

The display driving circuit includes a light emitting assembly 10. The light emitting assembly 10 includes a light emitting unit 110. The light emitting unit 110 may be a lamp bead of the Mini-LED, and the light emitting unit 110 is configured to emit light, and then implement a screen display.

The light emitting assembly 10 further includes a first control switch T2 and a second control switch T3.

The first control switch T2 has a first terminal connected to a cathode of the light emitting unit 110, a second terminal connected to a common terminal 30, and a control terminal connected to a first signal wire. The first signal wire is configured to provide a first control signal, and the first control switch T2 disconnects the common terminal 30 and the cathode of the light emitting unit 110 in response to the first control signal. It is understood that the common terminal 30 may be a common ground terminal, and a voltage of the common ground terminal is lower than an anode voltage of the light emitting unit 110. The cathode of the light emitting unit 110 is connected to the common terminal 30 to ensure that the anode voltage of the light emitting unit 110 is higher than a cathode voltage thereof, and an anode potential of the light emitting unit 110 is higher than a cathode potential thereof so that the voltage flows from the high potential to the low voltage, and thereby lighting the light emitting unit 110 smoothly.

The second control switch T3 has a first terminal connected to the charging terminal 40, a second terminal connected to the anode of the light emitting unit 110, and a control terminal connected to a second signal wire. The second signal wire is configured to provide a second control signal, and the second control switch T3 disconnects the anode of the light emitting unit 110 and the charging terminal 40 in response to the second control signal.

When the light emitting unit 110 is turned off, after the charging terminal 40 completes the charging and lighting of the light emitting unit 110, the first control switch T2 disconnects the cathode of the light emitting unit 110 and the common terminal 30 in response to the first control signal. The second control switch T3 disconnects the anode of the light emitting unit 110 and the charging terminal 40 in response to the second control signal to prevent the light emitting unit 110 from being affected by the voltage of the charging terminal 40.

According to the technical solution of this embodiment, the first control switch T2 responds to the first control signal, and the first control switch T2 controls the disconnection of the cathode of the light emitting unit 110 and the common terminal 30, to reduce the influence on the cathode of the light emitting unit 110 from the external environment. The charging terminal 40 is configured to provide power for lighting the light emitting unit 110, and the second control switch T3 disconnects the anode of the light emitting unit 110 and the charging terminal 40 in response to the second control signal, after the charging terminal 40 completes charging the light emitting unit 110, to reduce the influence on the anode of the light emitting unit 110 from the external environment. After the light emitting unit 110 completes the lighting and display, the light emitting unit 110 is turned off and both the anode and the cathode of the light emitting unit 110 are disconnected from the external environment. Therefore, the external current cannot enter the light emitting unit 110, and thus can reduce the influence of the external current on the light emitting unit 110. This can reduce the flashing of the brightness of the display panel, and ensure the normal display of the display panel.

The light emitting assembly 10 further includes a reset switch T1, the reset switch T1 has a first terminal connected to a voltage reset terminal 20, a second terminal connected to the anode of the light emitting unit 110, and a control terminal connected to a reset signal wire. The voltage reset terminal 20 is configured to provide a reset voltage. The reset switch T1 is configured to response to the reset signal and communicate the anode of the light emitting unit 110 and the voltage reset terminal 20. The voltage reset terminal 20 is configured to supply the reset voltage to the light emitting unit 110 before lighting the light emitting unit 110 every time, and the reset voltage is supplied to the anode of the light emitting unit 110 to complete the voltage reset of the light emitting unit 110. The light emitting units 110 are at the same reference voltage before being charged, the reference voltage may be understood as the reset voltage.

That is to say, when the light emitting unit 110 is charged at the same reference voltage, the brightness of the light emitting units 110 are different as the reference voltages are different, which easily causes the brightness of the light emitting unit 110 to be higher than or lower than the lighting requirement. Therefore, by resetting the voltage, the reference voltage in each of light emitting units 110 is the same initially. It is convenient to control the brightness of the light emitting unit 110.

The voltage reset terminal 20 is configured to supply a reset voltage, and the reset switch T1 responds to the reset signal, and the reset switch T1 controls the anode of the light emitting unit 110 to be in communication with the voltage reset terminal 20 to allow the anode of the light emitting unit 110 to reset the voltage.

In order to further simplify the circuit structure, the reset switch T1, the first control switch T2 and the second control switch T3 are connected to the identical scan wire, and the reset signal, the first control signal and the second control signal are the identical scan signal. As such, the reset switch T1, the first control switch T2, and the second control switch T3 may be controlled simultaneously through the same scan wire, and thereby reducing the layout of scan wires and simplifying the circuit structure.

Of course, when the reset switch T1 is turned on, the first control switch T2 and the second control switch T3 are disconnected. When the reset switch T1 is disconnected, the first control switch T2 and the second control switch T3 are turned on. That is to say, on-off state of the reset switch T1 is opposite to that of the first control switch T2 and the second control switch T3. The reset switch T1 is one of the P-type FET and the N-type FET, and the first control switch T2 and the second control switch T3 are the other one of the P-type FET and the N-type FET. It is ensured that the on-off state of the reset switch T1 is opposite to the on-off states of the other two switches for response.

For example, the reset switch T1 is a P-type FET, and the first control switch T2 and the second control switch T3 are N-type FETs. Upon the control terminal of the reset switch T1 receiving a low level, the reset switch T1 is turned on. Upon the control terminals of the first control switch T2 and the second control switch T3 receiving a low level, the first control switch T2 and the second control switch T3 are disconnected. Upon the control terminal of the reset switch T1 receiving a high level, the reset switch T1 is disconnected. Upon the control terminals of the first control switch T2 and the second control switch T3 receiving a high level, the first control switch T2 and the second control switch T3 are turned on.

Alternatively, the reset switch T1 is an N-type FET, and the first control switch T2 and the second control switch T3 are P-type FETs. Upon the control terminal of the reset switch T1 receiving a low level, the reset switch T1 is disconnected. Upon the control terminals of the first control switch T2 and the second control switch T3 receiving a low level, the first control switch T2 and the second control switch T3 are turned on. Upon the control terminal of the reset switch T1 receiving a high level, the reset switch T1 is turned on. Upon the control terminals of the first control switch T2 and the second control switch T3 receiving a high level, the first control switch T2 and the second control switch T3 are disconnected.

In order to accurately complete voltage initialization of the light emitting unit 110, a second terminal of the reset switch T1 is connected to a second terminal of the second control switch T3. Therefore, the reset voltage supplied at a voltage initiation terminal is supplied between the second control switch T3 and the light emitting unit 110. The initialization of the second control switch T3 is also completed while completing the voltage initialization of the light emitting unit 110. As such, the influence on the light emitting unit 110 due to electricity leakage of the second control switch T3 can be effectively reduced.

In one embodiment, the light emitting assembly 10 is provided at N rows, 2≤N, where N is a positive integer, and the display driving circuit includes a voltage reset terminal 20; In the light emitting assembly 10 at a first row, the first terminal of the reset switch T1 is connected to the voltage reset terminal 20, and the second terminal is correspondingly connected to the anode of the light emitting unit 110 of the light emitting assembly at the first row. As for the anode of the light emitting unit 110 of the light emitting assembly at the first row, the reset voltage flows from the voltage reset terminal 20 to the anode of the light emitting unit 110.

In the of light emitting assembly at an N-throw, the first terminal of the reset switch T1 is connected to the anode of the light emitting unit 110 of the light emitting assembly at the N-throw, and the second terminal is connected to the voltage reset terminal 20. Starting from the second row, when the voltage reset is performed, the voltage flows from the anode of the light emitting unit to the voltage reset terminal 20.

The display driving circuit further includes a unidirectional switch 50. The unidirectional switch 50 is disposed between the reset switch T1 at the N-th row and the voltage reset terminal 20. The arrangement of the unidirectional switch 50 can avoid reverse flow of voltage and reduce the influence on the light emitting unit. The unidirectional switch 50 can be understood as a diode switch.

For a clearer description of this embodiment, the above solutions are further described.

In the light emitting assembly at the first row, the first terminal of the reset switch T1 is connected to the voltage reset terminal, and the second terminal thereof is connected to the anode of the light emitting unit 110 of the light emitting assembly at the first row. When the voltage is reset, the voltage at the voltage reset terminal flows to the anode of the light emitting unit.

In the light emitting assembly at the N-throw, the first terminal of the reset switch T1 is connected to the anode of the light emitting unit 110 of the light emitting assembly at the N-throw, and the second terminal is connected to the first terminal of the reset switch of light emitting assembly at the (N+1)-throw. When the voltage is reset, the voltage of the anode of the light emitting unit flows to the voltage reset terminal.

In the light emitting assembly at the (N+1)-throw, the first terminal of the reset switch T1 is also connected to the anode of the light emitting unit of the light emitting assembly at the (N+1)-throw, and the second terminal is connected to the first terminal of the reset switch of light emitting assembly at the (N+2)-throw. When the voltage is reset, the voltage of the anode of the light emitting unit 110 flows to the voltage reset terminal.

In the light emitting assembly at the (N+2)-throw, the first terminal of the reset switch T1 is also connected to the anode of the light emitting unit of the light emitting assembly at the (N+2)-th row, and the second terminal is connected to the voltage reset terminal. When the voltage is reset, the voltage of the anode of the light emitting unit 110 flows to the voltage reset terminal.

The unidirectional switch 50 is provided in a wire between the reset switch T1 at the N-th row and the reset switch T1 at the (N+1)-th row, and the unidirectional switch 50 is also provided in a wire between the reset switch T1 at the (N+1)-th row and the reset switch T1 at the (N+2)-th row. The unidirectional switch is configured to uni-directionally conduct the wire from the reset switch at the N-th row to the reset switch at the (N+1)-th row, thereby ensuring that the voltage of the anode of the light emitting unit 110 flows to the voltage reset terminal 20 and prevent the voltage of the charging terminal 40 from flowing in reverse to the light emitting units 110 at the previous rows through the unidirectional switch 50. It can also be understood that the voltage reset terminal 20 extends a wire connecting the light emitting assembly at the N-th row to the light emitting assembly at the (N+2)-throw at the same time.

In one embodiment, the display driving circuit further includes a common terminal 30 and a common wire, the common wire extends from the common terminal 30, and each of the second terminal of the first control switch T2 of the light emitting assemblies 10 is connected to the common wire. A plurality of light emitting units 110 share a set of common wires, which can reduce leads at the common terminal 30 and simplify the circuit design.

In one embodiment, the light emitting assembly 10 includes a plurality of light emitting units 110, and the plurality of light emitting units 110 are connected in parallel. The cathodes of the light emitting units 110 connected in parallel are connected to the same cathode wire, and the anodes of the light emitting units 110 connected in parallel are connected to the same anode wire. The first control switch T2 is disposed on the cathode wire, and the second control switch T3 is disposed on the anode wire. The first control switch T2 and the second control switch T3 enable on-off control of the plurality of light emitting units 110 connected in parallel.

The display driving circuit includes a plurality of charging terminals 40. Each light emitting assembly 10 is provided with one charging terminal 40. The charging terminal 40 is configured to supply a charging voltage to the corresponding light emitting assembly 10. The charging voltages supplied by the charging terminals 40 to the corresponding light emitting assembly 10 may be the same or different in magnitude. Generally, the charging voltages supplied by the charging terminals 40 are different in magnitude, and the display driving circuit supplies different charging voltages to the charging terminals 40 according to the display requirements.

Embodiment 2

Figure 5:
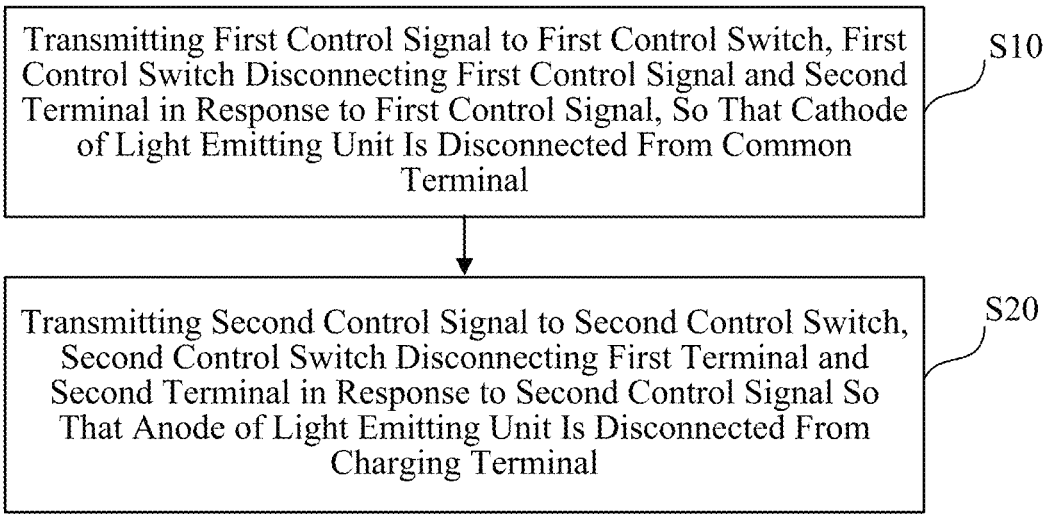
FIG. 5 is a flow chart showing that a light emitting unit of any one of the light emitting assemblies in the display driving method according to a second embodiment of the present disclosure is turned off.

Referring to FIG. 5, the present disclosure further provides a display driving method, which is applied to the display driving circuit. The display driving method includes steps of:

S10, transmitting a first control signal to a first control switch, wherein the first control switch disconnects a first terminal and a second terminal of the first control switch in response to the first control signal, so that a cathode of a light emitting unit is disconnected from a common terminal; and S20, transmitting a second control signal to a second control switch, wherein the second control switch disconnects a first terminal and a second terminal of the second control switch in response to the second control signal, so that an anode of the light emitting unit is disconnected from a charging terminal.

Through S10 and S20, the first control switch responds to the first control signal, and the second control switch responds to the second control signal. After the light emitting unit is turned off, the first control switch controls the disconnection of the cathode and the common terminal of the light emitting unit to reduce the influence on the cathode of the light emitting unit from the external environment. The second control switch disconnects the anode of the light emitting unit and the charging terminal, after the charging terminal completes the charging of the light emitting unit, to reduce the influence on the anode of the light emitting unit from the external environment. After the lighting of the light emitting unit is completed, the light emitting unit is turned off, and the anode and cathode of the light emitting unit are disconnected from the external environment. Therefore, the external current cannot enter the light emitting unit, to reduce the influence of the external current on the light emitting unit, so as to reduce the flashing of the brightness of the display panel, and thus ensure the normal display of the display panel.

Figure 4:
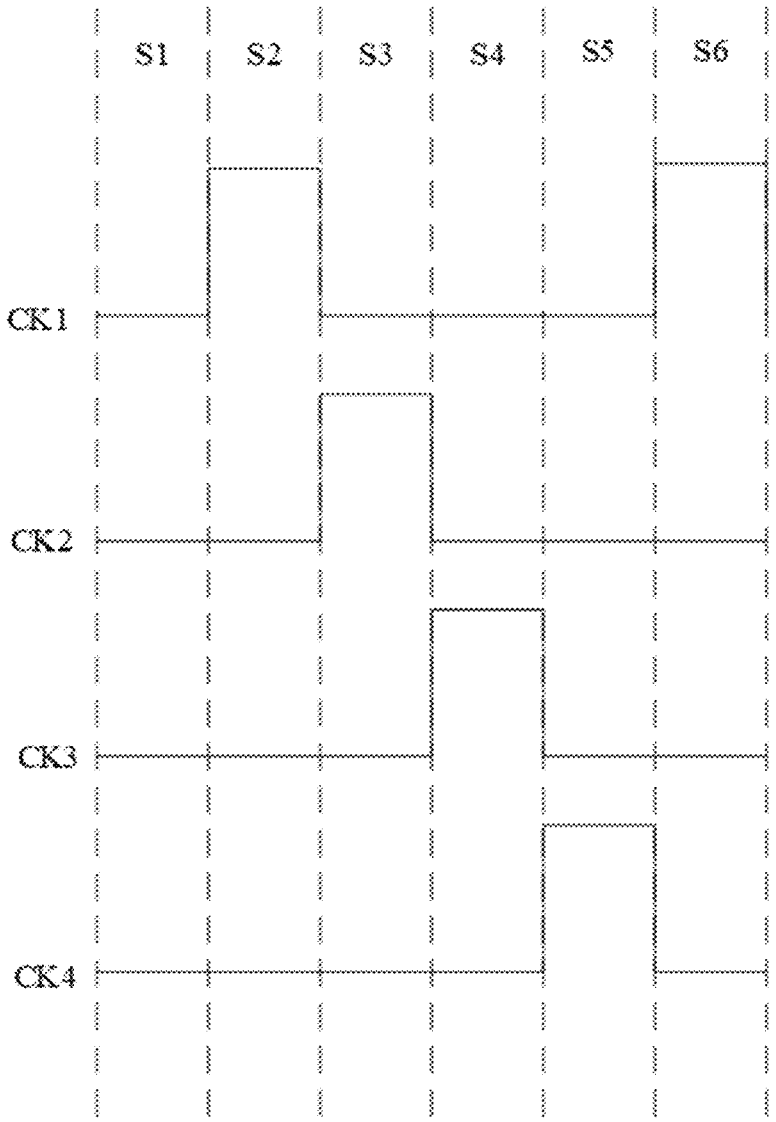
FIG. 4 is a timing control diagram of a display driving circuit in FIG. 3 according to the present disclosure.
Figure 6:
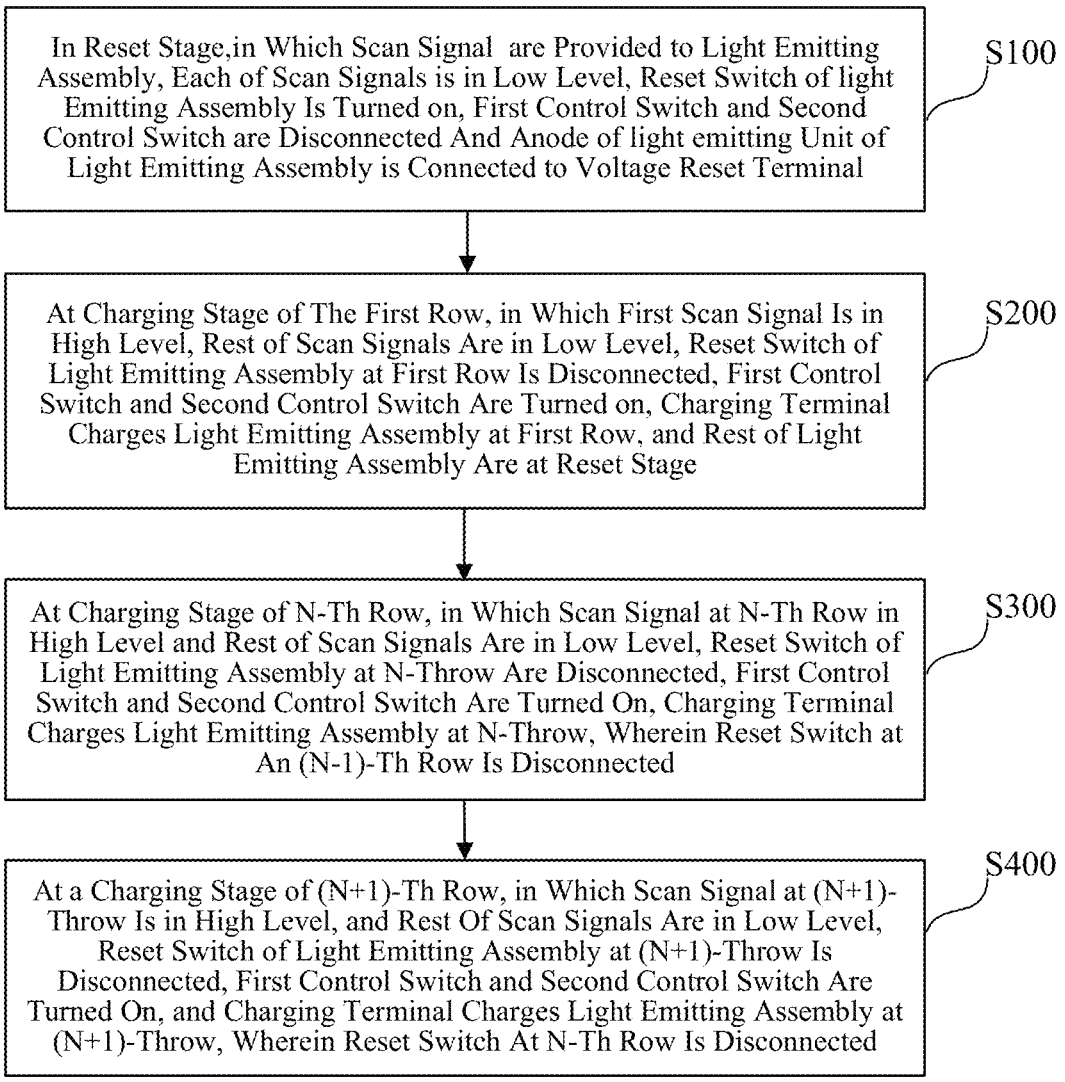
FIG. 6 is a flow chart showing that each of the light emitting assemblies in the display driving method according to the second embodiment of the present disclosure is lighted and turned off.

Referring to FIG. 4 and FIG. 6, the present disclosure further provides a display driving method, the display driving method is applied to the display driving circuit, one of the light emitting assemblies in the display driving circuit is correspondingly provided with one row of scan wires, the scan wires at a first row are correspondingly connected to control terminals of a reset switch T1, the first control switch T2 and the second control switch T3 of the light emitting assembly 10 at the first row, and the scan wire at the first row is configured to provide first a scan signal; and the scan wire at an N-throw is connected to a control terminal of the reset switch T1, the first control switch T2 and the second control switch T3 of the light emitting assembly 10 at the N-throw, the scan wire at the N-throw is configured to provide an N-th scan signal.

The display driving method includes steps of:

S100, at a reset stage, a scan signal is provided to the light emitting assembly 10, each of the scan signals is in a low level, the reset switch T1 of the light emitting assembly 10 at each row is turned on, the first control switch T2 and the second control switch T3 are disconnected, and the anode of the light emitting unit 110 of the light emitting assemblies 10 at each row is connected to a voltage reset terminal 20; and the reset stage is denoted as S1, the first scan signal is denoted with CK1. The voltage reset of the light emitting unit 110 of light emitting assembly 10 at each row is completed at the same time. It should be emphasized that in the voltage reset of the first row of light emitting unit 110, the anode voltage of the light emitting unit 110 is 0 since no operation of the charging terminal 40 is performed at an initial state. Thus, at the reset stage, a voltage flows from the voltage reset terminal 20 to the light emitting unit 110 of light emitting unit 110 at the first row. Starting from the second row, the charging terminal 40 in the display driving circuit begins to charge power. In order to degrade the anode voltage of the light emitting unit 110 at the reset stage, starting from the second row, the anode voltage of the light emitting unit 110 flows to the voltage reset terminal 20.

The first terminal in response to the switch is a source electrode, the second terminal is a drain electrode, and the control terminal is a grid electrode. Generally, the source electrode is used as an input terminal of voltage signal, and the drain electrode is used as an output terminal of voltage signal. Therefore, for the light emitting assembly 10 at the first row, the source electrode of the reset switch T1 is connected to the voltage reset terminal 20, and the drain electrode of the reset switch T1 is connected to the anode of the light emitting unit 110. The voltage flows from the voltage reset terminal 20 to the anode of the light emitting unit 110. For the light emitting assembly 10 at the second row, the source electrode of the reset switch T1 is connected to the anode of the light emitting unit 110, and the drain electrode of the reset switch T1 is connected to the voltage reset terminal 20, and the voltage flows from the anode of the light emitting unit 110 to the voltage reset terminal 20.

S200, at the charging stage of the first row, the first scan signal is in a high level, the rest scan signals are in a low level, the reset switch T1 of the light emitting assembly 10 at the first row is disconnected, the first control switch T2 and the second control switch T3 are turned on, the charging terminal 40 charges the light emitting assembly 10 at the first row, and the rest light emitting assemblies 10 are at the reset stage; the reset switch T1 is a P-type FET, and the first control switch and the second control switch T3 are N-type FETs. At the charging stage of the first row, corresponding to the S2, it can be seen that the level of CK1 in S2 is high, and the levels of CK2, CK3 and CK4 are low. At this time, the light emitting assembly of the first row is lightened.

S300, at the charging stage of the N-throw, the scan signal at the N-th row is in a high level, the rest of the scan signals are in a low level, the reset switch T1 of the light emitting assembly 10 at the N-th row is disconnected, the first control switch and the second control switch T3 are turned on, the charging terminal 40 charges the corresponding light emitting assembly 10 at the N-th row, the first control switch T2 at the (N−1)-th row is disconnected; the (N−1)-th row can be understood as the first row, when the second wire is lightened, the first row is disconnected from the external environment to prevent the light emitting assembly 10 at the first row from being affected by the external environment.

The charging stage of the N-th row is S3, and the scan signal at the N-th row is CK2. It can be seen that the level of CK2 in S3 is high, and the level of CK1, CK3 and CK4 are low. At this time, the light emitting assembly at the N-th row is lightened, which can also be understood as lighting the light emitting assembly in the second row.

Step S400, the (N+1)-th row charging stage, the (N+1)-throw of scan signal is of high level, the rest of the scan signals are in a low level, the reset switch T1 of the light emitting assembly 10 at the (N+1)-th row is disconnected, the first control switch and the second control switch T3 are turned on, and the charging terminal 40 charges the corresponding light emitting assembly 10 at the (N+1)-th row, the first control switch T2 at the (N+1)-th row is disconnected, and the (N+1)-th row can be understood as the third row. When the light emitting assembly at the third row is lightened, the second wire light emitting assembly 10 is disconnected from the external environment to avoid the external influence on the second wire light emitting assembly 10 from the external environment.

The charging stage of the (N+1)-th row is S4, and the scan signal at the (N+1)-throw is CK3. It can be seen that the level of CK3 in S4 is high, and levels of CK1, CK2 and CK4 are low. At this time, lighting the light emitting assembly at the (N+1)-th row may also be understood as lighting the light emitting assembly of the third row.

Further, the scan signal at the (N+2)-th row may be understood as CK4. In the charging state of the (N+2)-th row, the scan signal at the (N+2)-th row is in a high level and the rest of the scan signals are in a low level. The reset switch T1 of the light emitting assembly 10 at the (N+2)-th row is disconnected, the first control switch and the second control switch T3 are turned on, and the charging terminal 40 charges the corresponding light emitting assembly 10 at the (N+2)-th row, and the first control switch T2 at the (N+1)-th row is disconnected. In S5, the light emitting assembly 10 at the (N+2)-th row is charged. It can be seen that the level of CK4 in the S5 is high, and levels of CK1, CK2 and CK3 are low. At this time, lighting the light emitting assembly at the (N+2)-th row may also be understood as lighting the light emitting assembly at the fourth row.

S2 to S5 may be understood as a scanning period, and the light emitting assembly 10 at the first row is recharged to emit light in S6. It can be seen that the scanning of the light emitting assemblies at four rows indicates completion of one scanning period, so the number of light emitting assemblies is at least four rows or times of four rows of light emitting assemblies in the display panel.

Therefore, at the charging stage, scanning and charging are carried out row by row from the first row to the (N+2)-th row. The lighting of the previous row is completed after scanning and charging are completed in the previous row. When scanning and lighting of the posterior row, the anode and cathode of the light emitting unit 110 of the light emitting assembly 10 at the previous row are disconnected from the external environment, so that the light emitting unit 110 at the previous row may not be affected by the lighting of the subsequent light emitting assembly 10, thereby reducing accidental flashing of the light emitting unit 110 at the previous row.

Embodiment 3

Figure 7:
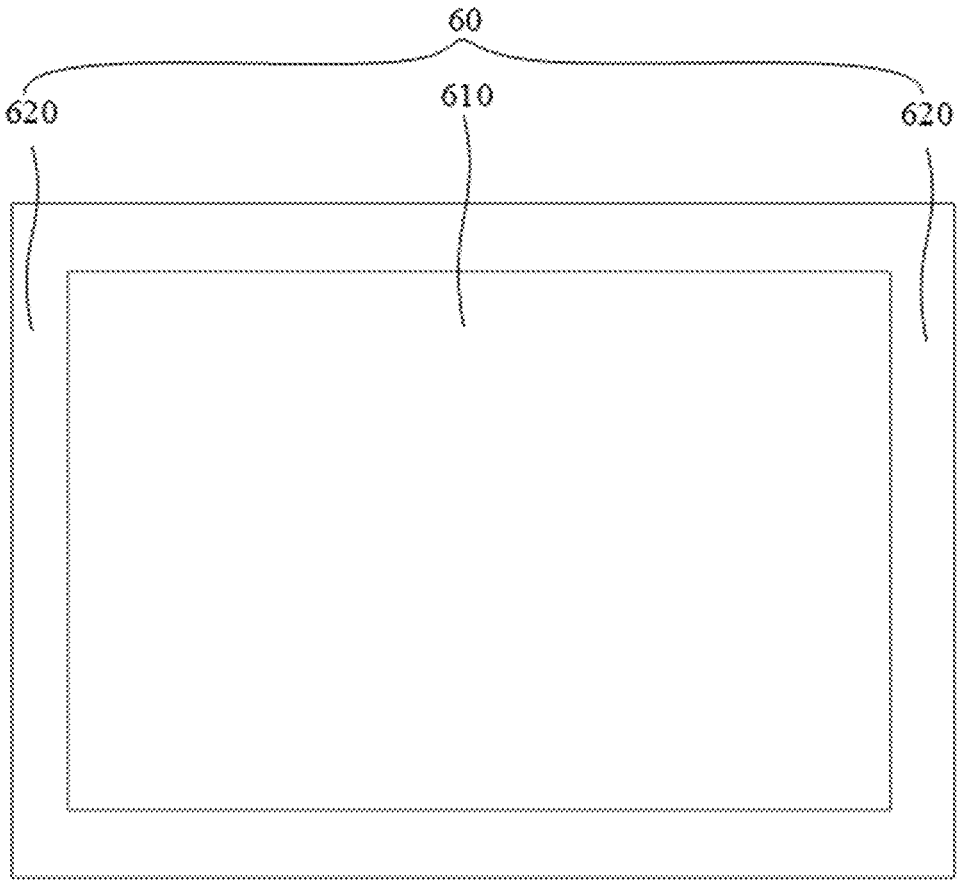
FIG. 7 is a schematic structural view of a display device according to a third embodiment of the present disclosure.

Referring to FIG. 7, the present disclosure also provides a display device, including a display panel 60. The display panel 60 has a display area 610 and a non-display area 620, the non-display area 620 is arranged at a periphery of the display area 610, and the display device also includes a display driving circuit, the display driving circuit includes the light emitting assembly 10. The light emitting assembly 10 includes the reset switch T1, the first control switch T2 and the second control switch T3. The reset switch T1, the first control switch T2, and the second control switch T3 are arranged in the non-display area 620, and the light emitting unit 110 is arranged in the display area 610. In this way, the non-display area 620 is located in a frame of the display panel 60, and the reset switch T1, the first control switch T2, and the second control switch T3 make full use of the frame of the display panel 60, to reduce the influence on the display screen.

The light emitting assembly 10 controls a wire at an input terminal and a wire at an output terminal of the light emitting unit 110 by the reset switch T1, the first control switch T2, and the second control switch T3, to implement on-off control of the input terminal and the output terminal of the light emitting unit 110, and then disconnect the light emitting unit 110 from the external environment. The input terminal of the light emitting unit 110 is the cathode of the light emitting unit 110, and the output terminal of the light emitting unit 110 is the anode of the light emitting unit 110.

The reset switch T1 has a first terminal connected to the voltage reset terminal 20, and a second terminal connected to the anode of the light emitting unit 110. The reset switch T1 is configured to communicate the anode of the light emitting unit 110 and the voltage reset terminal 20 in response to the reset signal. The voltage reset terminal 20 is configured to supply a reset voltage to the light emitting unit 110 before lighting the light emitting unit 110 every time, and the reset voltage is supplied to the anode of the light emitting unit 110 to complete the voltage reset of the light emitting unit 110. The light emitting units 110 are at the same reference voltage before being charged, the reference voltage can be understood as the reset voltage.

That is to say, when the light emitting unit 110 is charged at the same reference voltage, the light emitting units 110 have different brightness as the reference voltages are different, which easily causes the brightness of the light emitting unit 110 to be higher than or lower than the lighting requirement. Therefore, the reference voltages of the light emitting units 110 are initially the same by resetting the voltage. It is convenient to control the brightness of the light emitting unit 110.

One end of the first control switch T2 is connected to the cathode of the light emitting unit 110 and the other end thereof is connected to the common terminal 30, and the first control switch T2 disconnects the cathode of the light emitting unit 110 and the common terminal 30 in response to the first control signal. The common terminal 30 may be understood as a common ground terminal, and the voltage of the common ground terminal is lower than the anode voltage of the light emitting unit 110. The cathode of the light emitting unit 110 is connected to the common terminal 30 to ensure that the anode voltage of the light emitting unit 110 is higher than the cathode voltage, and the anode potential is higher than the cathode potential of the light emitting unit 110 so that the voltage flows from the high potential to the low voltage, thereby lighting the light emitting unit 110 smoothly.

One end of the second control switch T3 is connected to the charging terminal 40 and the other end thereof is connected to the anode of the light emitting unit 110. The second control switch T3 disconnects the anode of the light emitting unit 110 and the charging terminal 40 in response to the second control signal. After the charging terminal 40 completes the charging, and the light emitting unit 110 is lightened, the second control switch T3 disconnects the anode of the light emitting unit 110 and the charging terminal 40 in response to the second control signal, so that the light emitting unit 110 is prevented from being affected by the voltage of the charging terminal 40.

Although the present disclosure has been described with reference to several exemplary embodiments, it should be understood that the terms used herein are illustrative and exemplary and are not limited. Since the present disclosure can be embodied in various forms without departing from the spirit or essence of the present disclosure, it should therefore be understood that the foregoing embodiments are not limited to any of the foregoing details, but are to be interpreted broadly within the spirit and scope defined by the appended claims, so that all variations and modifications falling within the scope of the claims or their equivalents are to be covered by the appended claims.

What is claimed is:

1. A display driving circuit, comprising:

a light emitting assembly, the light emitting assembly comprising a light emitting unit, and the light emitting assembly further comprising:

a first control switch having a first terminal connected to a cathode of the light emitting unit, a second terminal connected to a common terminal, and a control terminal connected to a first signal wire, the first signal wire being configured to provide a first control signal; and a second control switch having a first terminal connected to a charging terminal, a second terminal connected to an anode of the light emitting unit, and a control terminal connected to a second signal wire, the second signal wire being configured to provide a second control signal;

wherein when the light emitting unit is turned off, the first control switch disconnects the cathode of the light emitting unit and the common terminal in response to the first control signal, and the second control switch disconnects the anode of the light emitting unit and the charging terminal in response to the second control signal;

wherein the light emitting assembly further comprises a reset switch, the reset switch has a first terminal connected to a voltage reset terminal, a second terminal connected to the anode of the light emitting unit, a control terminal connected to a reset signal wire, the voltage reset terminal is configured to provide a reset voltage, and the reset signal wire is configured to provide a reset signal; and when the light emitting unit is turned off, the reset switch communicates the anode of the light emitting unit and the voltage reset terminal in response to the reset signal; wherein the voltage reset terminal provides the reset voltage to the anode of the anode of the light emitting unit so that the light emitting units maintain a same reference voltage before being charged;

wherein the reset switch, the first control switch and the second control switch are connected to an identical scanning terminal, and the reset signal, the first control signal and the second control signal are identical scan signals; and wherein the reset switch is one of a P-type field-effect transistor and an N-type field-effect transistor, and the first control switch and the second control switch are another of the P-type field-effect transistor and the N-type field-effect transistor.

2. The display driving circuit according to claim 1, wherein the second terminal of the reset switch is connected to the second terminal of the second control switch.

3. The display driving circuit according to claim 1, wherein the light emitting assembly is provided at N rows, where $2 \leq N$, and N is a positive integer;

wherein in the light emitting assembly at a first row, the first terminal of the reset switch is connected to the voltage reset terminal, and the second terminal of the reset switch is correspondingly connected to the anode of the light emitting unit in the light emitting assembly at the first row;

wherein in the light emitting assembly at an N-throw, the first terminal of the reset switch is connected to the anode of the light emitting unit in the light emitting assembly at the N-th row, and the second terminal of the reset switch is connected to the voltage reset terminal; and wherein the display driving circuit further comprises a unidirectional switch disposed between the reset switch at an N-th row and the voltage reset terminal.

4. The display driving circuit according to claim 3, wherein one of the light emitting assemblies in the display driving circuit is correspondingly provided with a scan wire at one row, the scan wire at a first row is correspondingly connected to the control terminal of each of a reset switch, the first control switch and the second control switch of the light emitting assembly at the first row, and the scan wire at the first row is configured to provide a first scan signal;

wherein the scan wire at an N-throw is connected to the control terminal of each of the reset switch, the first control switch and the second control switch of the light emitting assembly at the N-throw, the scan wire at the N-throw is configured to provide an N-th scan signal, the reset switch is a P-type field effect transistor, the first control switch and the second control switch are N-type field effect transistors.

5. The display driving circuit according to claim 3, wherein the display driving circuit further includes a common wire extending from the common terminal, the common wire is connected to the second terminal of the first control switch of the light emitting assembly at each row.

6. The display driving circuit according to claim 5, wherein a plurality of light emitting units share a set of common wires.

7. The display driving circuit according to claim 1, wherein the light emitting assembly comprises a plurality of the light emitting units, and the plurality of the light emitting units are connected in parallel;

wherein the display driving circuit comprises a plurality of charging terminals, the light emitting assembly is correspondingly provided with one of the plurality of charging terminals, and the charging terminal is configured to provide a charging voltage to the corresponding light emitting assembly.

8. The display driving circuit according to claim 7, wherein the charging voltages supplied by the charging terminals to the corresponding light emitting assembly are the same or different in magnitude.

9. The display driving circuit according to claim 1, wherein the common terminal is a common ground terminal, and a voltage of the common ground terminal is lower than an anode voltage of the light emitting unit.

10. A display driving method applied to a display driving circuit, wherein the display driving circuit comprises a light emitting assembly, the light emitting assembly comprising a light emitting unit, and the light emitting assembly further comprising:

a first control switch having a first terminal connected to a cathode of the light emitting unit, a second terminal connected to a common terminal, and a control terminal connected to a first signal wire, the first signal wire being configured to provide a first control signal; and a second control switch having a first terminal connected to a charging terminal, a second terminal connected to an anode of the light emitting unit, and a control terminal connected to a second signal wire, the second signal wire being configured to provide a second control signal;

wherein when the light emitting unit is turned off, the first control switch disconnects the cathode of the light emitting unit and the common terminal in response to the first control signal, and the second control switch disconnects the anode of the light emitting unit and the charging terminal in response to the second control signal;

wherein the light emitting assembly further comprises a reset switch, the reset switch has a first terminal connected to a voltage reset terminal, a second terminal connected to the anode of the light emitting unit, a control terminal connected to a reset signal wire, the voltage reset terminal is configured to provide a reset voltage, and the reset signal wire is configured to provide a reset signal; and wherein when the light emitting unit is turned off, the reset switch communicates the anode of the light emitting unit and the voltage reset terminal in response to the reset signal;

the voltage reset terminal provides the reset voltage to the anode of the anode of the light emitting unit so that the light emitting units maintain a same reference voltage before being charged;

wherein the reset switch, the first control switch and the second control switch are connected to an identical scanning terminal, and the reset signal, the first control signal and the second control signal are identical scan signals; and wherein the reset switch is one of a P-type field-effect transistor and an N-type field-effect transistor, and the first control switch and the second control switch are another of the P-type field-effect transistor and the N-type field-effect transistor;

wherein the display driving method comprises:

transmitting the first control signal to the first control switch, the first control switch disconnecting the first terminal and the second terminal in response to the first control signal, so that the cathode of the light emitting unit is disconnected from the common terminal; and transmitting the second control signal to the second control switch, the second control switch disconnecting the first terminal and the second terminal in response to the second control signal, so that the anode of the light emitting unit is disconnected from the charging terminal.

11. The display driving method according to claim 10, wherein the display driving method is applied to the display driving circuit, wherein the light emitting assembly is provided at N rows, where $2 \leq N$, and N is a positive integer;

wherein in the light emitting assembly at a first row, the first terminal of the reset switch is connected to the voltage reset terminal, and the second terminal of the reset switch is correspondingly connected to the anode of the light emitting unit in the light emitting assembly at the first row;

wherein in the light emitting assembly at an N-throw, the first terminal of the reset switch is connected to the anode of the light emitting unit in the light emitting assembly at the N-th row, and the second terminal of the reset switch is connected to the voltage reset terminal; and wherein the display driving circuit further comprises a unidirectional switch disposed between the reset switch at an N-th row and the voltage reset terminal;

wherein one of the light emitting assemblies in the display driving circuit is correspondingly provided with a scan wire at one row, the scan wire at a first row is correspondingly connected to the control terminal of each of a reset switch, the first control switch and the second control switch of the light emitting assembly at the first row, and the scan wire at the first row is configured to provide a first scan signal;

wherein the scan wire at an N-throw is connected to the control terminal of each of the reset switch, the first control switch and the second control switch of the light emitting assembly at the N-throw, the scan wire at the N-throw is configured to provide an N-th scan signal, the reset switch is the P-type field effect transistor, the first control switch and the second control switch are the N-type field effect transistors; and wherein the display driving method comprises:

at a reset stage, in which scan signals are provided to the light emitting assembly, each of the scan signals is in a low level, the reset switch of the light emitting assembly is turned on, the first control switch and the second control switch are disconnected, and the anode of the light emitting unit of the light emitting assembly is connected to the voltage reset terminal;

at a charging stage of the first row, in which the first scan signal is in a high level, rest of the scan signals are in a low level, the reset switch of light emitting assembly at the first row is disconnected, the first control switch and the second control switch are turned on, the charging terminal charges the light emitting assembly at the first row, and rest of the light emitting assembly are at the reset stage;

at a charging stage of the N-th row, in which the scan signal at the N-th row in a high level and rest of the scan signals are in a low level, the reset switch of the light emitting assembly at the N-throw are disconnected, the first control switch and the second control switch are turned on, the charging terminal charges the light emitting assembly at the N-throw, wherein the reset switch at an (N−1)-th row is disconnected; and at a charging stage of an (N+1)-th row, in which the scan signal at the (N+1)-throw is in a high level, and rest of the scan signals are in a low level, the reset switch of light emitting assembly at the (N+1)-throw is disconnected, the first control switch and the second control switch are turned on, and the charging terminal charges the light emitting assembly at the (N+1)-throw, wherein the reset switch at the N-th row is disconnected.

12. A display device, comprising:

a display panel, the display panel having a display area and a non-display area, the non-display area being disposed at a periphery of the display area, wherein the display device further comprises the display driving circuit;

wherein the display driving circuit comprises:

a light emitting assembly, the light emitting assembly comprising a light emitting unit, and the light emitting assembly further comprising:

a first control switch having a first terminal connected to a cathode of the light emitting unit, a second terminal connected to a common terminal, and a control terminal connected to a first signal wire, the first signal wire being configured to provide a first control signal; and a second control switch having a first terminal connected to a charging terminal, a second terminal connected to an anode of the light emitting unit, and a control terminal connected to a second signal wire, the second signal wire being configured to provide a second control signal;

wherein when the light emitting unit is turned off, the first control switch disconnects the cathode of the light emitting unit and the common terminal in response to the first control signal, and the second control switch disconnects the anode of the light emitting unit and the charging terminal in response to the second control signal;

wherein the light emitting assembly further comprises a reset switch, the reset switch has a first terminal connected to a voltage reset terminal, a second terminal connected to the anode of the light emitting unit, a control terminal connected to a reset signal wire, the voltage reset terminal is configured to provide a reset voltage, and the reset signal wire is configured to provide a reset signal; and wherein when the light emitting unit is turned off, the reset switch communicates the anode of the light emitting unit and the voltage reset terminal in response to the reset signal; the voltage reset terminal provides the reset voltage to the anode of the anode of the light emitting unit so that the light emitting units maintain the same reference voltage before being charged;

wherein the reset switch, the first control switch and the second control switch are connected to an identical scanning terminal, and the reset signal, the first control signal and the second control signal are identical scan signals; and wherein the reset switch is one of a P-type field-effect transistor and an N-type field-effect transistor, and the first control switch and the second control switch are the other one of the P-type field-effect transistor and the N-type field-effect transistor;

wherein a first control switch and a second control switch are arranged in the non-display area, and a light emitting unit is located in the display area.

13. The display device according to claim 12, wherein the second terminal of the reset switch is connected to the second terminal of the second control switch.

14. The display device according to claim 12, wherein the light emitting assembly is provided at N rows, where 2≤N, and N is a positive integer;

wherein in the light emitting assembly at a first row, the first terminal of the reset switch is connected to the voltage reset terminal, and the second terminal of the reset switch is correspondingly connected to the anode of the light emitting unit in the light emitting assembly at the first row;

wherein in the light emitting assembly at an N-throw, the first terminal of the reset switch is connected to the anode of the light emitting unit in the light emitting assembly at the N-th row, and the second terminal of the reset switch is connected to the voltage reset terminal; and wherein the display driving circuit further comprises a unidirectional switch disposed between the reset switch at an N-th row and the voltage reset terminal.

15. The display device according to claim 14, wherein one of the light emitting assemblies in the display driving circuit is correspondingly provided with a scan wire at one row, the scan wire at a first row is correspondingly connected to the control terminal of each of a reset switch, the first control switch and the second control switch of the light emitting assembly at the first row, and the scan wire at the first row is configured to provide a first scan signal;

wherein the scan wire at an N-throw is connected to the control terminal of each of the reset switch, the first control switch and the second control switch of the light emitting assembly at the N-throw, the scan wire at the N-throw is configured to provide an N-th scan signal, the reset switch is a P-type field effect transistor, the first control switch and the second control switch are N-type field effect transistors.

16. The display device according to claim 14, wherein the display driving circuit further includes a common wire extending from the common terminal, the common wire is connected to the second terminal of the first control switch of the light emitting assembly at each row.

17. The display device according to claim 16, wherein a plurality of light emitting units share a set of common wires.

18. The display device according to claim 12, wherein the light emitting assembly comprises a plurality of the light emitting units, and the plurality of the light emitting units are connected in parallel;

the display driving circuit comprises a plurality of charging terminals, the light emitting assembly is correspondingly provided with one of the plurality of charging terminals, and the charging terminal is configured to provide a charging voltage to the corresponding light emitting assembly.

19. The display device according to claim 18, wherein the charging voltages supplied by the charging terminals to the corresponding light emitting assembly are the same or different in magnitude.

20. The display device according to claim 12, wherein the common terminal is a common ground terminal, and a voltage of the common ground terminal is lower than an anode voltage of the light emitting unit.

* * * * *